US012766590B2

(12) United States Patent
Bartig

(10) Patent No.: US 12,766,590 B2
(45) Date of Patent: Oct. 20, 2026

(54) PUNCH-RIVETING DIE, PUNCH-RIVETING TOOL AND METHOD FOR PRODUCING A PUNCH-RIVET JOINT

(71) Applicant: NEWFREY LLC, New Britain, CT (US)

(72) Inventor: Paul Bartig, Giessen (DE)

(73) Assignee: Newfrey LLC, New Britain, CT (US)

( * ) Notice: Subject to any disclaimer, the term of this patent is extended or adjusted under 35 U.S.C. 154(b) by 0 days.

(21) Appl. No.: 18/768,591

(22) Filed: Jul. 10, 2024

(65) Prior Publication Data

US 2025/0018460 A1 Jan. 16, 2025

(30) Foreign Application Priority Data

Jul. 10, 2023 (EP) ..... 23184342

(51) Int. Cl.
*B21J 15/04* (2006.01)
*B21J 15/30* (2006.01)

(52) U.S. Cl.
CPC ..... *B21J 15/041* (2013.01); *B21J 15/30* (2013.01)

(58) Field of Classification Search
CPC ..... B25J 15/025; B25J 15/36; F16B 19/086
See application file for complete search history.

(56) References Cited

U.S. PATENT DOCUMENTS 5,056,207 A 10/1991 Ladouceur
8,406,228 B2 3/2013 Bienas et al.
8,458,881 B1 * 6/2013 Danyo ..... B21J 15/36 29/432.1
9,919,356 B2 * 3/2018 Bartig ..... B21J 15/025
10,632,523 B2 4/2020 Henke et al.
10,960,457 B2 3/2021 Kawasaki et al.
2019/0084032 A1 * 3/2019 Henke ..... B21J 15/025
(Continued)

FOREIGN PATENT DOCUMENTS

EP 2631022 B1 * 6/2014 ..... F16B 19/086
EP 2872270 B1 4/2019
EP 3423211 B1 4/2021
(Continued)

OTHER PUBLICATIONS

JP2021115574A translation (Year: 2021).*
European Search Report dated Dec. 20, 2023 cited in corresponding EP Application No. 23184342.6.

*Primary Examiner* — Michael W Hotchkiss
(74) *Attorney, Agent, or Firm* — Harness, Dickey & Pierce, PLC

(57) ABSTRACT

A punch-riveting die for a punch-riveting tool for setting a semi-hollow punch rivet into a punch rivet joint. The die comprising a basic body with a sheet metal support surface and a recess for forming an underside of a punch-rivet joint. The recess is arranged rotationally symmetrically to the central axis of the punch-riveting die. The recess having a first annular base, a lower second annular base, and a lowest central cavity extending axially below the second base. A projection rises axially in the central part of the cavity. A first annular wall extends between the first annular base and the sheet metal support surface. A second annular wall extends between the first annular base and the second annular base. A third annular wall extends between the second annular base and the bottom of the cavity.

21 Claims, 2 Drawing Sheets

(56) References Cited

U.S. PATENT DOCUMENTS

2020/0156143 A1* 5/2020 Kawasaki ..... B21J 15/36

FOREIGN PATENT DOCUMENTS

| | | | | | |
|---|---|---|---|---|---|
| EP | 4035794 | A1 | | 8/2022 | |
| GB | 2459557 | A | * | 11/2009 | ..... B21J 15/048 |
| JP | H03210931 | A | | 9/1991 | |
| JP | 2018176237 | A | | 11/2018 | |
| JP | 2021115574 | A | * | 8/2021 | |
| WO | 2002002259 | A1 | | 1/2002 | |
| WO | 2007147551 | A1 | | 12/2007 | |
| WO | 2011023616 | A1 | | 3/2011 | |
| WO | 2014009129 | A1 | | 1/2014 | |
| WO | 2017148684 | A1 | | 9/2017 | |
| WO | 2018194021 | A1 | | 10/2018 | |

* cited by examiner

PUNCH-RIVETING DIE, PUNCH-RIVETING TOOL AND METHOD FOR PRODUCING A PUNCH-RIVET JOINT

CROSS-REFERENCE TO RELATED APPLICATIONS

This application claims priority from European Patent Application No. 23184342.6, filed Jul. 10, 2023, the disclosures of which are incorporated herein by reference in their entirety.

BACKGROUND OF THE INVENTION

The present application relates to self-piercing riveting (SPR) technologies. More specifically, the present application relates to dies used in during the installation of self-piercing rivets.

Self-pierce riveting (SPR) is a high-speed mechanical fastening process for joining two or more sheets of material without a predrilled or punched hole. Typically, SPR processes are conducted by driving a semi-hollow rivet through an uppermost workpiece layer and upsetting the rivet in a lowermost workpiece layer to form a durable mechanical joint. When driven into the workpiece arrangement, the hollow shank of the rivet widen radially and hereby creates an undercut that results in permanent joining of the workpieces. The end of the shank does not completely pierce the lowermost workpiece and does not protrude from the workpiece arrangement. Rather, a so-called residual base thickness of the material of the lowermost workpiece layer remains between the end of the rivet shank and the underside of the thus produced punch-rivet joint. To realize the SPR process, the lowermost workpiece layer is supported at a die. The die is arranged opposite to a punch adapted to drive the rivet into the workpiece arrangement.

There are different shapes and geometries of die, which can depend on the workpiece materials, rivet material and/or geometry, . . . but also the kind of joint to be achieved. The die plays an important role in the formation of a robust joint.

EP2872270A1 from the applicant for instance discloses a die comprising a basic body, which has a recess for forming an underside of a punch-rivet joint, the recess having a base and an annular wall. An annular radial-flow inhibiting device is realized in a central region of the base, which inhibiting device limits a radial material flow out of the inner region of the annular radial-flow inhibiting device. Such dies allow to realize joints which are axially compact and robust.

EP3423211A1 discloses a die comprising the following features: a main body having an upper side and a recess formed therein. The recess comprises an annular demolding section arranged radially outwardly, a subsequent or adjacent annular channel section and a centrally arranged die bottom, wherein in a cross section of the self-piercing riveting die extending parallel to the central axis a demolding inclination of the demolding section encloses with the upper side of the self-piercing riveting die an angle $\propto$ in the range of $5° \leq \propto \leq 45°$.

In vehicle construction, with the use of megacasting, there is an increasing need in joining materials of different strength, and notably high strength steel or ultra-high strength steel workpieces with cast aluminium. More generally, there is an increasing need to join brittle materials, like die-casting aluminium, (which are therefore non deformable), without risks of cracks within the rivet, within the brittle material workpiece (notably on the outside and on the shank area of the rivet when the brittle material workpiece is the lowermost workpiece). There is also a need to have a die which avoids the collapse of the rivet during the setting step and which allows a high joining force.

BRIEF SUMMARY OF THE INVENTION

Accordingly, the present invention provides a punch-riveting die according to claim 1. More particularly, the punch-riveting die is for a punch-riveting tool for setting a semi-hollow punch rivet with a rivet shank inner diameter into a punch rivet joint. The punch-riveting die comprises a basic body with a sheet metal support surface and a recess for forming an underside of a punch-rivet joint, the recess is arranged rotationally symmetrically to the central axis of the punch-riveting die, the recess having a first annular base, a second annular base and a central cavity extending axially below the second base of the recess. A projection is realized in the central part of the cavity and a first annular wall extends between the first base and the sheet metal support surface, a second annular wall extends between the first base and the second base, and a third annular wall extends between the second base and the bottom of the cavity.

The projection within the cavity is such that a ring groove is formed. The present geometry with three levels allows the joining between high strength steel or ultra-high strength steel and brittle cast aluminium for instance without the formation of cracks or without altering the performance of the joint. The cavity is such that the rivet compresses as little as possible and can form a sufficient undercut.

In an embodiment, the first annular base is inclined with respect to the plane defined by the sheet metal support surface. This improves the material intake to avoid cracks and increase the die volume.

In an embodiment, the first annular base is curved. Thus, an optimization of the flow behavior of aluminum casting is realized.

In an embodiment, the first annular base comprises a convex flow barrier. The flow barrier positively influences the material behavior and reduces the tensions on the rivet, the die and workpieces.

In an embodiment, the first annular base comprises a first end connected to the first annular wall and a second end opposite the first end and connected to the second annular wall, and wherein the second end is a rounded section, and wherein the second end is above the first end. The rounded section forms the convex flow barrier. The second end is above the first end, which means that the second end is in the axial direction closer from the sheet metal support surface than the first end. In other words, the second annular base is inclined such that its end in the vicinity of the cavity is axially above the first end. The second annular base forms a ramp.

In an embodiment, the first annular wall is realized in the manner of a truncated-cone surface. In an embodiment, the second annular wall is realized in the manner of a truncated-cone surface. In an embodiment, the third annular wall is realized in the manner of a truncated cone-surface.

In an embodiment, the first annular wall has a first tapered angle, the second annular wall has a second tapered angle, the second tapered angle being smaller than the first tapered angle. The first and second annular walls with the tapered angle allows a better demolding.

In an embodiment, the bottom of the cavity comprises a concave flow barrier. The flow barrier positively influences the material behavior and reduces the tensions on the rivet, the die and workpieces.

The present invention is also directed to a punch-riveting tool for setting a semi-hollow punch rivet into a punch rivet joint, the punch-riveting tool comprising: a frame; a punch-riveting head movable in a punching direction and including a punch-riveting punch operable for mounting the punch rivet to be set into the punch rivet joint; and a punch-riveting die as described above.

The punch-riveting tool is adapted to perform self-piercing riveting joints a with workpiece made of brittle material without decreasing the joint properties.

The present invention is also directed to a method for producing a punch-rivet joint of at least two workpieces, which are disposed on the top side of a punch-riveting die as described above, comprising the step of driving a semi-hollow punch rivet into the uppermost workpiece, a hollow shank of the semi-hollow punch rivet also penetrating into the lowermost workpiece and widening radially therein, an underside of the punch-rivet joint being formed by the punch-riveting die. In an embodiment, the uppermost workpiece is made of a high strength steel or ultra-high strength steel, and wherein the lowermost workpiece is made of brittle cast aluminum. The geometry of the die limits or avoids the creation of cracks within the rivet or the workpieces during the setting.

In an embodiment, the uppermost workpiece has a first thickness Tw, wherein the recess has an axial depth TA between the sheet metal support surface and the second base, and wherein the axial depth TA is in the range $Tw<TA<1.5Tw$, and in particular is in the range $Tw<TA<1.35Tw$. Thus, the undercut remains axially compact.

In an embodiment, the rivet has a rivet shank diameter Dr and the second annular wall has a second recess diameter DA2, and wherein the second recess diameter DA2 is in the range $0.8\ Dr<DA2<1.2Dr$. This contributes to the compactness of the undercut and the limitation of cracks and stress within the materials of the rivet and the workpieces.

It is understood that the above-mentioned features and those yet to be explained in the following can be applied, not only in the respectively specified combination, but also in other combinations or singly, without departure from the scope of the present invention.

BRIEF DESCRIPTION OF THE DRAWINGS

Other characteristics and advantages of the invention will readily appear from the following description of embodiments, provided as non-limitative examples, in reference to the accompanying drawings.

DETAILED DESCRIPTION OF THE PREFERRED EMBODIMENTS

On the different figures, the same reference signs designate identical or similar elements.

Figure 1:
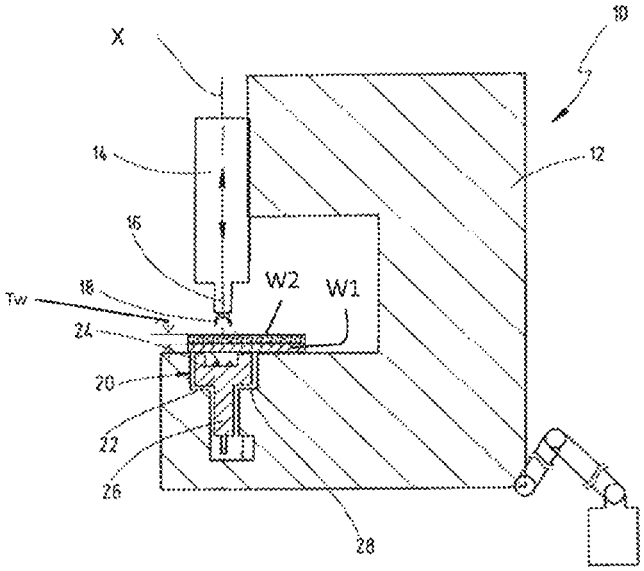
FIG. 1 shows a schematic representation of a punch-riveting tool according to the invention, with a punch-riveting die according to the invention.

FIG. 1 schematically shows a punch-riveting tool 10. The punch-riveting tool 10 comprises a frame 12, also called C-frame. At one end of the frame 12, in a known manner a carriage 14 is mounted so as to be displaceable along a longitudinal axis X (punching axis). A punch 16, for performing a punch-riveting process, is disposed on the carriage 14. A punch rivet 18 is held by means of a holding device.

The frame 12 further comprises at a second end, opposite the first end, a punch-riveting die receiver 20 for receiving a punch-riveting die 22.

The punch-riveting die 22 has a basic body 24 and has a die shank 26, of a lesser diameter, extending axially therefrom. The die shank 26 is adapted to be receive in an opening of the die receiver 20. A radial surface at the transition between the basic body 24 and the shank 26 bears on a shoulder 28 of the die receiver 20. The basic body 24 is preferably rotationally symmetrical in form.

The punch-riveting die 22, and more particularly the basic body 24, comprises a sheet metal support surface 30 which forms a first axial side. The sheet metal support surface 30, when the die 22 is mounted within the die receiver 20, is adapted to face towards the punch 16. The sheet metal support surface 30 is adapted to support workpiece layers destined to be joined.

In a punch-riveting process, usually, two or more workpieces W1, W2 in the form of sheets are disposed between the punch 16 and the die 22, and more particularly are supported by the sheet metal support surface 30 of the die 22. Further, it is possible to fix the workpiece stack in position with regard to the sheet metal support surface 30. The punch 16 is then moved downwards along the longitudinal axis X, such that the rivet 18 can be driven into the workpiece arrangement. A hollow shank of the punch rivet 18 in this case deforms radially within the workpieces and is deflected radially outwards, as a result of which a non-positive and/or positive joint is produced between the workpieces.

Figure 2:
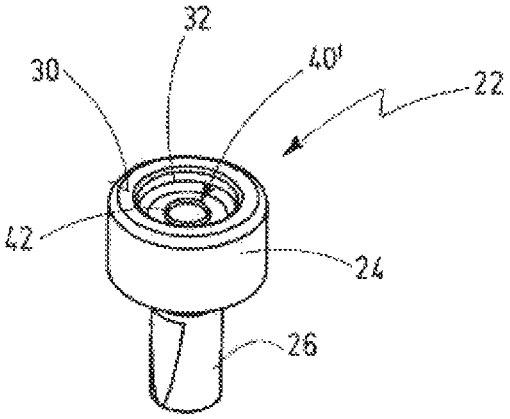
FIG. 2 shows a perspective view of the punch-riveting die of FIG. 1.
Figure 3:
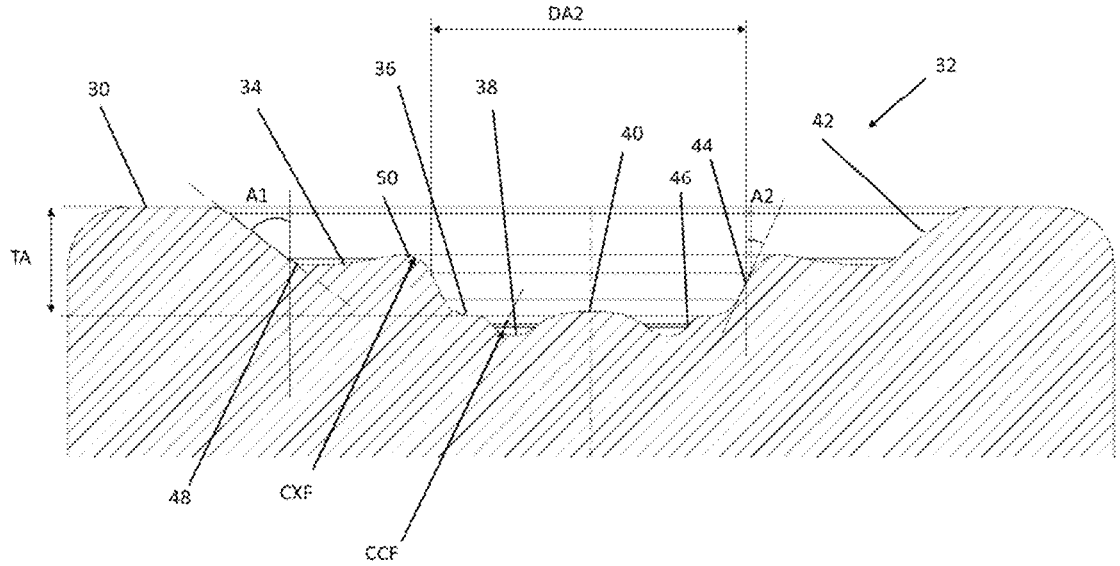
FIG. 3 shows a cross-sectional view of the upper part of the basic body of the punch-riveting die of FIG. 2.

The sheet metal support surface 30 comprises a recess 32 (see FIG. 2). The recess 32 is arranged rotationally symmetrically to the central axis of the punch-riveting die. The recess has a first annular base 34, a second annular base 36 and a central cavity 38 extending axially below the second annular base 36. The central cavity 38 is provided with a projection 40. The projection 40 is arranged in the central part of the central cavity 38. Thus, the central cavity 38 with the projection defines a ring groove.

The first annular base 34 extends axially below the sheet metal support surface 30. The second annular base 36 extends axially below the first annular base 34. In other words, the first annular base 34 extends axially between the sheet metal support surface 30 and the second annular base 36.

A first annular wall 42 extends between the sheet metal support surface 30 and the first annular base 34. The first annular wall 42 connects the sheet metal support surface 30 and the first annular base 34. The first annular wall 42 is realized in the manner of a truncated-cone surface.

A second annular wall 44 extends between the first annular base 34 and the second annular base 36. The second annular wall 44 connects the first annular base 34 and the second annular base 36. The second annular wall 44 is realized in the manner of a truncated-cone surface.

The first annular wall 42 has a first tapered angle A1. For instance, the first tapered angle A1 may be between 35 and 80 degrees. The second annular wall 44 has a second tapered angle A2. The second tapered angle A2 may be between 5 and 45 degrees. The second tapered angle A2 is smaller than the first tapered angle A1.

A third annular wall 46 extends between the second annular base 36 and the bottom of the central cavity 38. The third annular wall 46 connects the second annular base 36 and the bottom of the central cavity 38. The third annular wall 46 is realized in the manner of a truncated-cone surface. The third annular wall may have a tapered angle substantially similar to the second tapered angle A2.

The sheet metal support surface 30 extends along a plane which is sensibly horizontal. The first annular base 34 is inclined with respect to the plane defined by the sheet metal support surface 30. The first annular base 34 may also be slightly curved.

The first annular base 34 comprises a convex flow barrier CXF. The convex flow barrier prevents the brittle material from cracking at the shank of the rivet. The first annular base 34 comprises a first end 48 and a second end 50. The first end 48 contacts the first annular wall 42. The second end 50 contacts the second annular wall 44. The second end 50 is a rounded section. The second end 50 extends axially above the first end 48. The first annular base 34 forms a ramp which extends from the first end 48 to the second end 50, wherein the second end 50 is closer from the sheet metal support surface 30 than the first end 48. The ramp and/or the rounded section may form the convex flow barrier CXF.

The second annular base 36 comprises a first end contacting the second annular wall 44 and a second end contacting the third annular wall 46. The first end and the second end are for instance are essentially on the same plane or level, such that the axial distance between the first end and the sheet metal support surface 30 and the axial distance between the second end and the sheet metal support surface 30 are identical or substantially identical. The second end may also have a rounded portion. For instance, the second annular base 36 extends in a plane sensibly parallel to the plane of the sheet metal support surface 30.

The bottom of the cavity 38 comprises for instance a concave flow barrier CCF. The concave flow barrier CCF reduces the stress in the die and provides additional volume for the deformed material. The concave flow barrier is for instance formed by the ring groove.

The projection 40 may extend axially at the same height than the second annular base 36 or may be axially slightly above the second annular base 36. The projection 40 is for instance a rounded projection.

As mentioned above, for producing a punch-rivet joint of at least two workpieces, the workpieces W1 and W2 are first stacked and arranged on the sheet metal support surface 30 of the die 22. A semi-hollow punch rivet 18 is driven with the punch 16 into the uppermost workpiece W2. A hollow shank of the semi-hollow punch rivet 18 penetrates into the lowermost workpiece W1 and widens radially therein. The underside of the punch-rivet joint is then formed by the punch-riveting die 22. In a particular embodiment, the uppermost workpiece W2 is made of a high strength steel or ultra-high strength steel and the lowermost workpiece W1 is made of brittle cast aluminum. More generally, at least one of the workpiece is made of a brittle material like cast aluminum.

The uppermost workpiece W2 has a first thickness Tw. The recess 32 has an axial depth TA between the sheet metal support surface 30 and the second annular base 36. In an embodiment, the axial depth TA is in the range $Tw<TA<1.5Tw$, and in particular is in the range $Tw<TA<1.35Tw$.

The rivet 18 has a rivet shank diameter Dr and the second annular wall 44 has a second recess diameter DA2. The second recess diameter DA2 is in the range $0.8Dr<DA2<1.2Dr$.

What is claimed is:

1. A punch-riveting die for a punch-riveting tool for setting a semi-hollow punch rivet with a rivet shank into a punch rivet joint, the punch-riveting die comprising:

a body with a sheet metal support surface; and a recess for forming an underside of a punch-rivet joint, the recess being arranged rotationally symmetrically to a central axis of the punch-riveting die, and the recess having a first annular base, a second annular base and a central cavity extending axially below the second annular base of the recess, wherein a projection is realized in a central part of the central cavity, and wherein a first annular wall extends between the first annular base and the sheet metal support surface, a second annular wall connecting the first annular base and the second annular base, and a third annular wall extends between the second annular base and a bottom of the central cavity, the first annular base including a ramp and a rounded section, the ramp extending between the first annular wall and the rounded section, the rounded section forming a transition between the ramp and the second annular wall.

2. The punch-riveting die according to claim 1, wherein the ramp of the first annular base is inclined with respect to a plane defined by the sheet metal support surface as the ramp extends from the first annular wall to the rounded section.

3. The punch-riveting die according to claim 1, wherein the ramp of the first annular base has a different inclination angle than the first annular wall.

4. The punch-riveting die according to claim 1, wherein the first annular base comprises a convex flow barrier.

5. The punch-riveting die according to claim 1, wherein the first annular wall has a first truncated-cone surface.

6. The punch-riveting die according to claim 1, wherein the second annular wall has a second truncated-cone surface.

7. The punch-riveting die according to claim 1, wherein the third annular wall has a third truncated cone-surface.

8. The punch-riveting die according to claim 1, wherein the first annular wall has a first tapered angle, the second annular wall has a second tapered angle, and the second tapered angle being smaller than the first tapered angle.

9. The punch-riveting die according to claim 1, wherein the bottom of the central cavity comprises a concave flow barrier.

10. A punch-riveting tool for setting a semi-hollow punch rivet into a punch rivet joint, the punch-riveting tool comprising:

a frame;

a punch-riveting head movable in a punching direction and including a punch-riveting punch operable for mounting the punch rivet to be set into the punch rivet joint; and the punch-riveting die according to claim 1.

11. The punch-riveting die according to claim 1, wherein the ramp of the first annular base extends at an incline from the first annular wall to the rounded section.

12. A punch-riveting die for a punch-riveting tool for setting a semi-hollow punch rivet with a rivet shank into a punch rivet joint, the punch-riveting die comprising:

a basic body with a sheet metal support surface; and a recess for forming an underside of a punch-rivet joint, the recess being arranged rotationally symmetrically to a central axis of the punch-riveting die, and the recess having a first annular base, a second annular base and a central cavity extending axially below the second annular base of the recess, wherein a projection is realized in a central part of the central cavity, and wherein a first annular wall extends between the first annular base and the sheet metal support surface, a second annular wall extends between the first annular base and the second annular base, and a third annular wall extends between the second annular base and a bottom of the central cavity, wherein the first annular base comprises a first end connected to the first annular wall and a second end opposite the first end and connected to the second annular wall, and wherein the second end is a rounded section, and wherein the second end is axially above the first end.

13. A method for producing a punch-rivet joint comprising the steps of:

providing a punch-riveting die including:

a body with a sheet metal support surface and a recess for forming an underside of the punch-rivet joint, the recess being arranged rotationally symmetrically to a central axis of the punch-riveting die, the recess having a first annular base, a second annular base and a central cavity extending axially below the second annular base of the recess, wherein a projection is realized in a central part of the central cavity, and wherein a first annular wall extends between the first annular base and the sheet metal support surface, a second annular wall connecting the first annular base and the second annular base, and a third annular wall extends between the second annular base and a bottom of the central cavity, the first annular base including a ramp and a rounded section, the ramp extending between the first annular wall and the rounded section, the rounded section forming a transition between the ramp and the second annular wall;

positioning an uppermost workpiece over a lowermost workpiece, on the sheet metal support surface of the punch-riveting die; and driving a semi-hollow punch rivet into the uppermost workpiece, a hollow shank of the semi-hollow punch rivet penetrating into the lowermost workpiece and widening radially therein, the underside of the punch-rivet joint being formed by the punch-riveting die.

14. The method according to claim 13, wherein the uppermost workpiece is made of a high strength steel or ultra-high strength steel, and wherein the lowermost workpiece is made of brittle cast aluminum.

15. The method according to claim 13, wherein the uppermost workpiece has a first thickness Tw, wherein the recess has an axial depth TA between the sheet metal support surface and the second annular base, and wherein the axial depth TA is in the range $Tw<TA<1.5Tw$.

16. The method according to claim 13, wherein the semi-hollow punch rivet has a rivet shank diameter Dr and the second annular wall has a second recess diameter DA2, and wherein the second recess diameter DA2 is in the range $0.8Dr<DA2<1.2Dr$.

17. A punch-riveting die for a punch-riveting tool operable for setting a semi-hollow punch rivet into a punch rivet joint, the punch-riveting die comprising:

a body defining a central vertical axis and including a workpiece support surface extending perpendicular to and annular around the central vertical axis;

a recess partially defined by the body, open axially upward, radially inward of the workpiece support surface, and rotationally symmetrically to the central vertical axis;

a first annular base in the recess axially below and radially inward of the workpiece support surface;

a second annular base in the recess axially below and radially inward of the first annular base;

a central cavity in the recess axially below and radially inward of the second annular base;

a central projection extending axially upward from a bottom of the central cavity;

a first annular wall between the workpiece support surface and the first annular base;

a second annular wall between the first annular base and the second annular base; and a third annular wall between the second annular base and the bottom of the central cavity, wherein the first annular base includes a first end proximate the first annular wall and a second end proximate to the second annular wall, and the first end is axially below the second end.

18. The punch-riveting die according to claim 17, wherein the first annular base in cross section curves axially upward between the first end and the second end.

19. The punch-riveting die according to claim 18, further comprising a rounded edge transition between the first annular base and the second annular wall.

20. The punch-riveting die according to claim 17, wherein at least one of the first annular wall, the second annular wall, and the third annular wall is a frustoconical surface tapering radially inward as it extends axially downward, and the frustoconical surface defines a taper angle acute with the central vertical axis.

21. The punch-riveting die according to claim 20, wherein:

the first annular wall includes a first frustoconical surface with a first taper angle;

the second annular wall incudes a second annular surface with a second taper angle; and the second taper angle is less than the first taper angle.

* * * * *